US005207834A

United States Patent [19]

Curtis et al.

[11] Patent Number: 5,207,834

[45] Date of Patent: May 4, 1993

[54] SLIDE COATING APPARATUS WITH MOVING PLATES

[75] Inventors: Frederick E. Curtis; Terrance W. Grant, both of Rochester; Roberto D. Marcuccio, Brockport; Siegfried R. Scheske, Pavilion, all of N.Y.

[73] Assignee: E. I. Du Pont de Nemours and Company, Wilmington, Del.

[21] Appl. No.: 692,656

[22] Filed: Apr. 29, 1991

[51] Int. Cl.[5] ..... B05C 5/00; B05C 3/18

[52] U.S. Cl. ..... 118/410; 118/407; 118/411; 118/412; 118/325; 425/225

[58] Field of Search ..... 118/410, 411, 412, 325, 118/407, DIG. 4; 425/192 R, 225

[56] References Cited

U.S. PATENT DOCUMENTS 4,283,443 8/1981 Choinski ..... 118/50

*Primary Examiner*—W. Gary Jones

*Assistant Examiner*—Todd J. Burns

*Attorney, Agent, or Firm*—Thomas H. Magee

[57] ABSTRACT

A slide coating apparatus includes at least one slide surface disposed along a top portion of a front plate supported by a platform. A fluid supply cavity for supplying a coating fluid to the slide surface is formed at the juncture of a side surface of the front plate with a side surface of a back plate contiguous with the front plate and moveably supported by the platform. A biasing plate applies force to the back plate to maintain the back plate contiguous to the front plate. The invention includes apparatus for moving the back plate away from the front plate to a first cleaning position along a direction substantially parallel to the slide surface. The moving apparatus comprises at least one actuator assembly connected between the back plate and the platform for effecting linear movement along a direction substantially parallel to the slide surface.

9 Claims, 5 Drawing Sheets

SLIDE COATING APPARATUS WITH MOVING PLATES

FIELD OF THE INVENTION

This invention pertains to a slide coating apparatus with moving plates. More particularly, the apparatus separates at least one plate from an adjacent second plate and then returns the one plate next to the second plate.

BACKGROUND OF THE INVENTION

Conventional multi-slide coating apparatus perform coating operations by metering individual layers of a coating fluid from a supply source, through a trough disposed inside a hopper, and then through a narrow distribution slot. A coating fluid is distributed by the slot as a layer uniformly across a downwardly inclined surface of a slide. The layer of coating fluid flows by gravity down the slide surface and meets with adjacent underlayers of coating fluid which have been similarly metered and distributed through narrow slots. The combined layers of coating fluid then flow down the slide surface and form a coating bead. A web to be coated is carried by a backup roll and passes across the bead. The fluid layers in the bead impinge upon the moving web which picks up the multiple fluid layers from the slide surface. Illustrative slide coating apparatus are disclosed in U.S. Pat. No. 2,761,417, U.S. Pat. No. 3,289,632, U.S. Pat. No. 4,283,443, and U.S. Pat. No. 4,443,504.

In a coater facility, the slide coating apparatus includes at least two plates to form a fluid supply cavity, i.e., hopper, trough, and distribution slot. Typically, several plates are used to supply multiple fluids to the slide surface. In coating photosensitive materials, it is frequently necessary to separate the plates and clean the cavity area between each of the plates, such as when a different photosensitive formulation is to be coated or when there is an accumulation of hardened or dried solution retained or caught in the cavity. It is desirable to be able to readily and quickly clean the slide coating apparatus, in particular the cavities, for greater productivity of the coater facility. In operation, the separation and cleaning of the plates can be a time-consuming and cumbersome process. Typically, the plates are made of heavy-gauge metal and can be in the range of 12 inches to 120 inches wide in size, which precludes manual movement of the plates. Conventionally, the plates are separated from a coating position with a hand-crank mechanism which is bolted onto a side of the plates, and the crank mechanism is manually engaged. The procedure is then reversed when the plates are returned to the coating position. When the plates are particularly wide, a cranking mechanism is necessary on both sides of the plates, thus assuring essentially parallel separation of the plates, but adding to the time and effort required.

Therefore it is an object of this invention to provide an apparatus for moving one plate from an adjacent second plate and for returning the one plate in contact with the adjacent second plate in a slide coating apparatus.

It is another object of this invention to provide a method for separating plates in a slide coating apparatus whereby cleaning of the cavity areas is readily and quickly accomplished.

SUMMARY OF THE INVENTION

The present invention is a slide coating apparatus comprising at least one slide surface disposed along a top portion of a front plate supported by a platform. A fluid supply cavity for supplying a coating fluid to the slide surface is formed at the juncture of a side surface of the front plate with a side surface of a back plate contiguous with the front plate and moveably supported by the platform. A biasing plate applies force to the back plate to maintain the back plate contiguous to the front plate. The invention includes apparatus for moving the back plate away from the front plate to a first cleaning position along a direction substantially parallel to the slide surface. The moving apparatus comprises at least one actuator assembly connected between the back plate and the platform for effecting linear movement along a direction substantially parallel to the slide surface.

DETAILED DESCRIPTION OF THE PREFERRED EMBODIMENT

Figure 1:
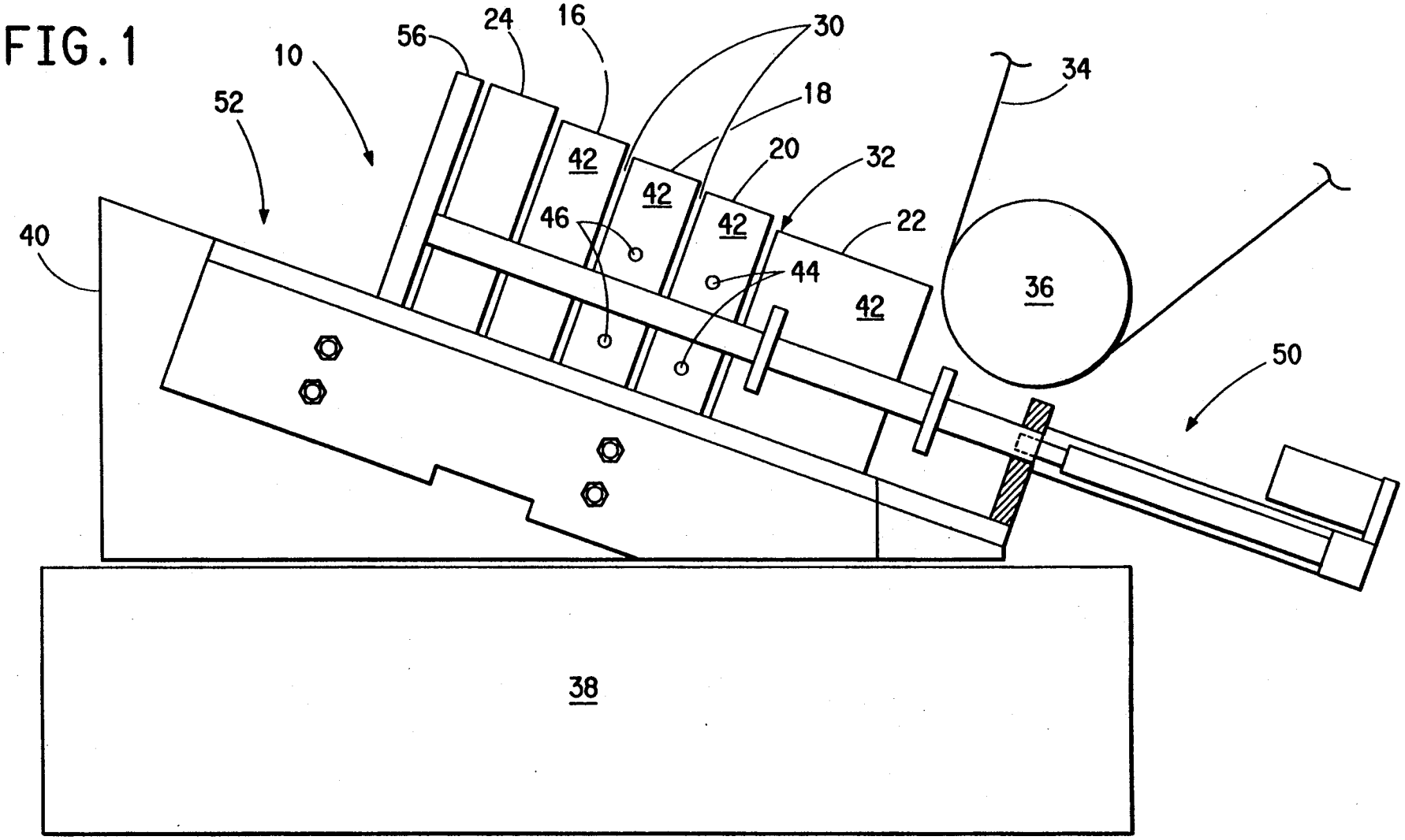
FIG. 1 is a schematic elevation view of a slide coating apparatus on a carriage assembly showing part of a preferred embodiment of the present invention.

FIG. 1 shows a slide coating apparatus 10 which includes a coating head comprising a plurality of distribution headers or plates 16, 18, 20, 22 joined together by a suitable biasing plate 24. It is to be understood that any predetermined number of plates may be disposed within the coating head and remain within the contemplation of the present invention. At the juncture of each plate with its adjacent plate, a fluid supply cavity 30 is formed. Coating fluid (not shown for simplicity) is supplied from a reservoir (not shown) and is pumped through each cavity to a distribution slot. As the coating fluid wells from the mouth of each distribution slot, it is accelerated by gravity along an inclined slide surface 32 toward a web 34 carried by a backup roll 36. The slide surfaces of the plates 16, 18, 20 and 22 are parallel to each other. The plates are supported transversely across their width by at least two support rails which are suitably attached to a carriage assembly 38. Only one support rail 40 is shown. Each of the distribution plates 16, 18, 20 and 22 has opposite side ends 42 in which two spaced openings 44 and 46 may be located. The spaced openings 44 and 46 are located on the side ends 42 so as not to interfere with auxiliary systems of the coating apparatus, such as water distribution manifolds, etc. The purpose of the openings will be discussed in greater detail below.

The coating apparatus 10 includes an actuator assembly 50 and a support assembly 52. The actuator assembly 50 provides for linear movement of at least one of the plates on the support rails. The actuator assembly 50 is connected to an end portion of a connector plate 56 disposed farthest or substantially farthest from the backup roll 36. The support assembly 52 is mounted on the exterior side of the support rail 40 closest to the side ends 42 of the distribution plates.

Figure 2:
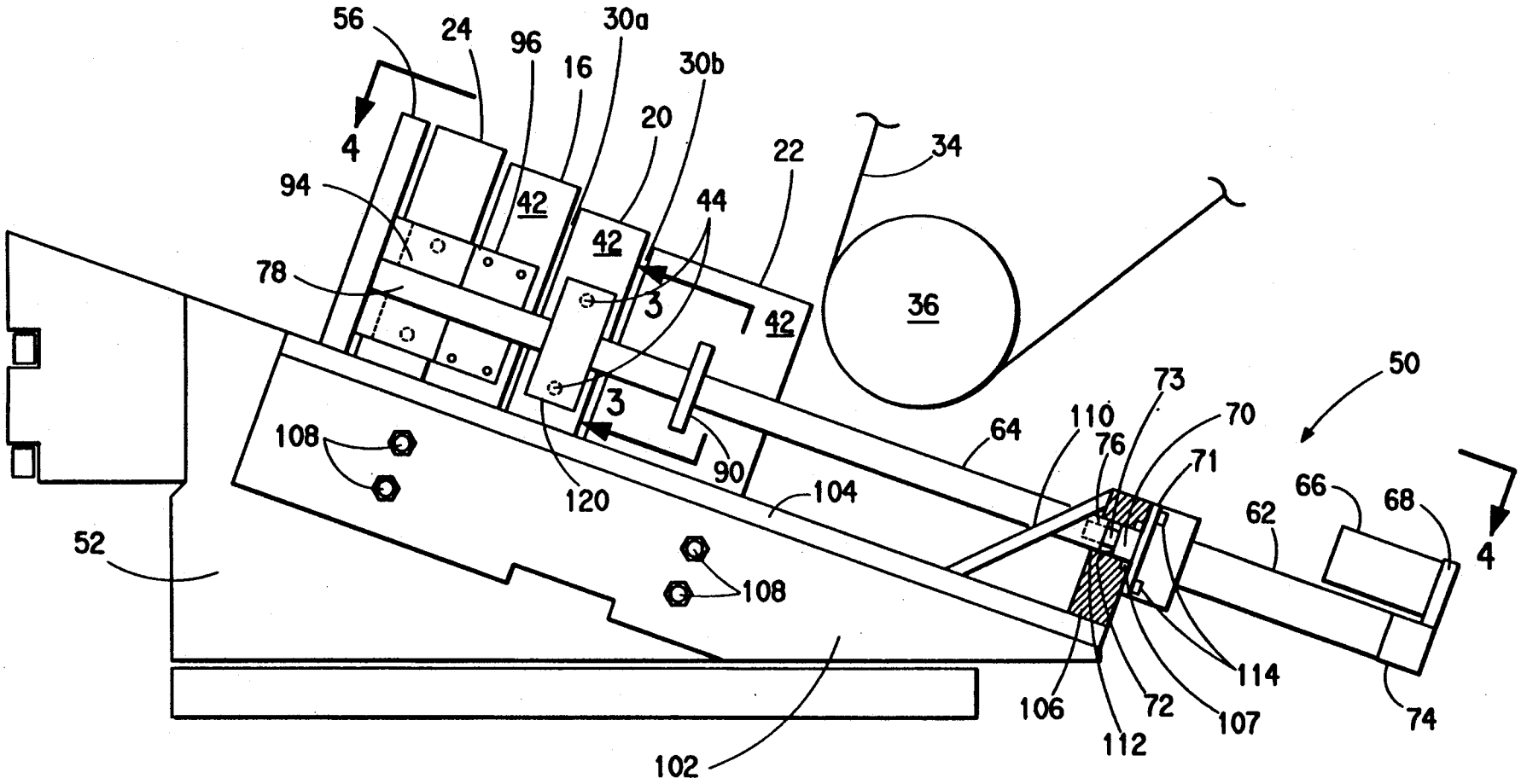
FIG. 2 is an elevation view of the preferred embodiment of the present invention in position on the left side of the slide coating apparatus shown in FIG. 1.
Figure 4:
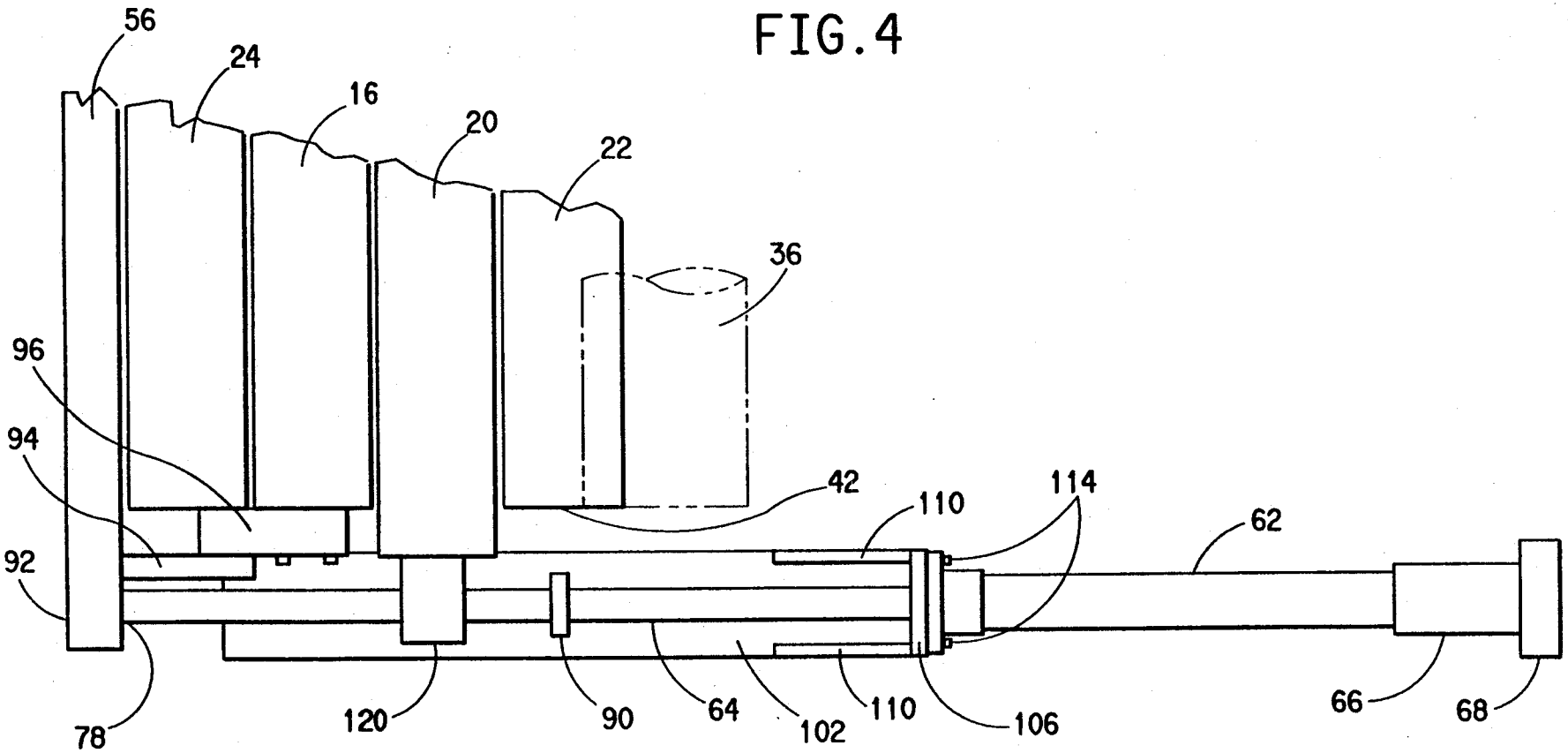
FIG. 4 is a partial planar view of the slide coating apparatus shown in FIG. 2 taken along line 4—4 of FIG. 2.

FIGS. 2 and 4 illustrate a preferred embodiment of the present invention wherein the coating head comprises three distribution plates 16, 20 and 22 and the biasing plate 24 for the distribution of 2 coating fluids from cavities 30*a* and 30*b*, respectively. In FIG. 2, the actuator assembly 50 includes an actuator 62, and an external shaft 64. The actuator 62 includes a motor assembly 66, a drive assembly 68, a shaft 70 internal to the actuator, and a plate 71 mounting the actuator assembly 50 to the support assembly 52. Linear motion actuators which are conventional in the art are suitable for use in this invention such as, for example. pneumatic, electropneumatic, electrohydraulic, and electromechanical. An electromechanical actuator sold by Industrial Devices Corporation, Novato CA, as model D2201, is preferred. Conventional drive assemblies are suitable for use in this invention; a timing belt using a DC motor is preferred. The actuator shaft 70 has a first end 72 and a second end 74 opposite the first end 72. The external shaft 64 has a first end 76 and a second end 78 opposite the first end 76. The first end 72 of the actuator shaft 70 is connected to the first end 76 of the external shaft 64. The first end 72 of the actuator shaft 70 has a threaded portion 73 which cooperatively couples with an opening in the first end 76 of the external shaft 64.

The external shaft 64 is located parallel to the side ends 42 of the plates and is positioned such that the shaft 64 is centered or substantially centered between the spaced openings 44 in the side end 42 of the plate 20. This positioning provides for linear movement of the external shaft 64 along a direction parallel to and at the same, or essentially the same, angle as the inclined surface 32 of the slide coating apparatus 10. The external shaft 64 has one collar 90 fixedly mounted between the first 76 and second 78 ends. The number of collars 90 mounted on the external shaft 64 is dependent upon the number of plates which need to be moved for separation of cavities. The spacing between the collars on the external shaft 64 will depend in particular upon the desired distance between plates when separated, as well as the depth of the plates, the distance needed to move the plates in order for all cavities to be opened, as well as other considerations knowledgeable to those skilled in the art.

FIG. 4 shows the second end 78 of the external shaft 64 connected to an extended end portion 92 of the connector plate 56. The end portion 92 extends past the plane of the side ends 42 of the plates 16, 20, 22 and 24. The connector plate 56 is attached to the biasing plate 24 of the coating head. The connector plate 56 and the biasing plate 24 can be connected to the distribution plate 16 disposed farthest from the backup roll 36 by a tie bar 94 coupled between the connector plate 56 and a water distribution block 96 located on the farthest distribution plate 16. This coupling of the connector plate 56, the biasing plate 24 and the distribution plate 16 enables the three plates to move as one when the external shaft 64 is moving. It should be understood that an existing slide coating apparatus can be modified to accommodate the apparatus of the present invention, such as by the attachment and coupling of the connector plate 56 to the farthest distribution plate 16 as described above. Also, it should be evident that a new slide coating apparatus can be made to have end portions extending from the plate farthest or essentially farthest from the backup roll, i.e., the biasing plate 24.

The support assembly 52 includes a first member 102, a second or platform member 104 and a third member 106. The first member 102 is mounted to the exterior side of the support rail 40 closes to the side ends 42 of the plates. The first member 102 can be shaped to conform to the support rail 40. The first member 102 has a plurality of openings 108 through which fastening means such as bolts are used to mount the first member 102 to the rail 40. The second member 104 is perpendicular to the first member 102, and is parallel or substantially parallel to the slide surface 32. The third member 106 is perpendicular to the platform plane of the second member 104 and located at or near the low end of the second member 104. One or more brace members 110 secure the second member 104 to the third member 106. The mounting plate 71 of the actuator assembly 50 is connected to the third member 106 of the support assembly 52 by bolts 114, but can be connected by any suitable fastening means. The third member 106 has a passage 112 in which the internal shaft of the actuator 70 passes when the actuator shaft is set in motion. An O-ring 107 is press fit into the passage 112 to reduce or substantially eliminate noise associated with movement of the actuator 62 and prevent contamination by airborne particulate entering the actuator 62. The support assembly 52 can be a unitary structure or a composite structure wherein the first, second and third members are attached and assembled by conventional means. The support assembly 52 can be made of any material suitable to support the actuator assembly 50 and the cantilevered weight of the actuator 62. The preferred material for the actuator 62 is stainless steel.

Figure 3:
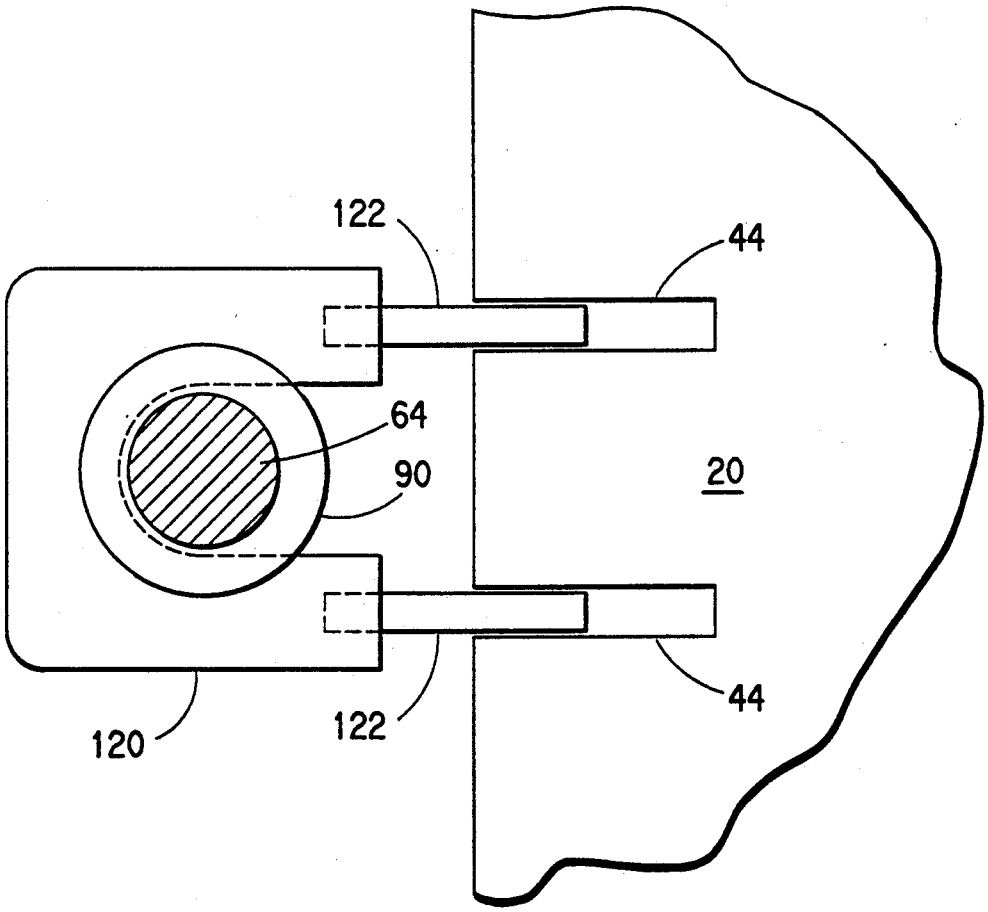
FIG. 3 is a partial cross-sectional view taken along line 3—3 of FIG. 2, showing a U-shaped block subsequently engaging a collared shaft of the apparatus of this invention.

FIG. 3 illustrates a U-shaped block 120 which is about to engage the collar 90 on the external shaft 64. The U-shaped block 120 has extended leg members 122 which are shaped to fit in the spaced openings 44 on the side end 42 of the plate 20. The U-shaped 120 block can be made of any suitable material, preferably stainless steel. Once the U-shaped block 120 is in place about the external shaft 64 and the extended legs 122 are inserted in the side openings 44, the block 120 is engaged by the collar 90 as the collar 90 and the shaft 64 move linearly. Since the collar 90 is fixed to the external shaft 64, the linear motion is translated to the plate 20, thereby causing the plate 20 to move along the support rails 40.

FIG. 4 illustrates the slide coating apparatus of the present invention disposed on the left side of the coating apparatus. It should be understood that FIGS. 1, 2, 4 and 5 show one side of a slide coating apparatus with the apparatus of this invention in place. A mirror image of the structure illustrated in FIGS. 1, 2, 4 and 5, but for certain parts which would be redundant, can also be located on the right side of the slide coating apparatus. Preferably, the apparatus of this invention is located on both the left and right sides of the coating apparatus. Both apparatus would be coupled to the extended end portions 92 of the connector plate 56 and would operate in parallel when both apparatus are energized.

Figure 5:
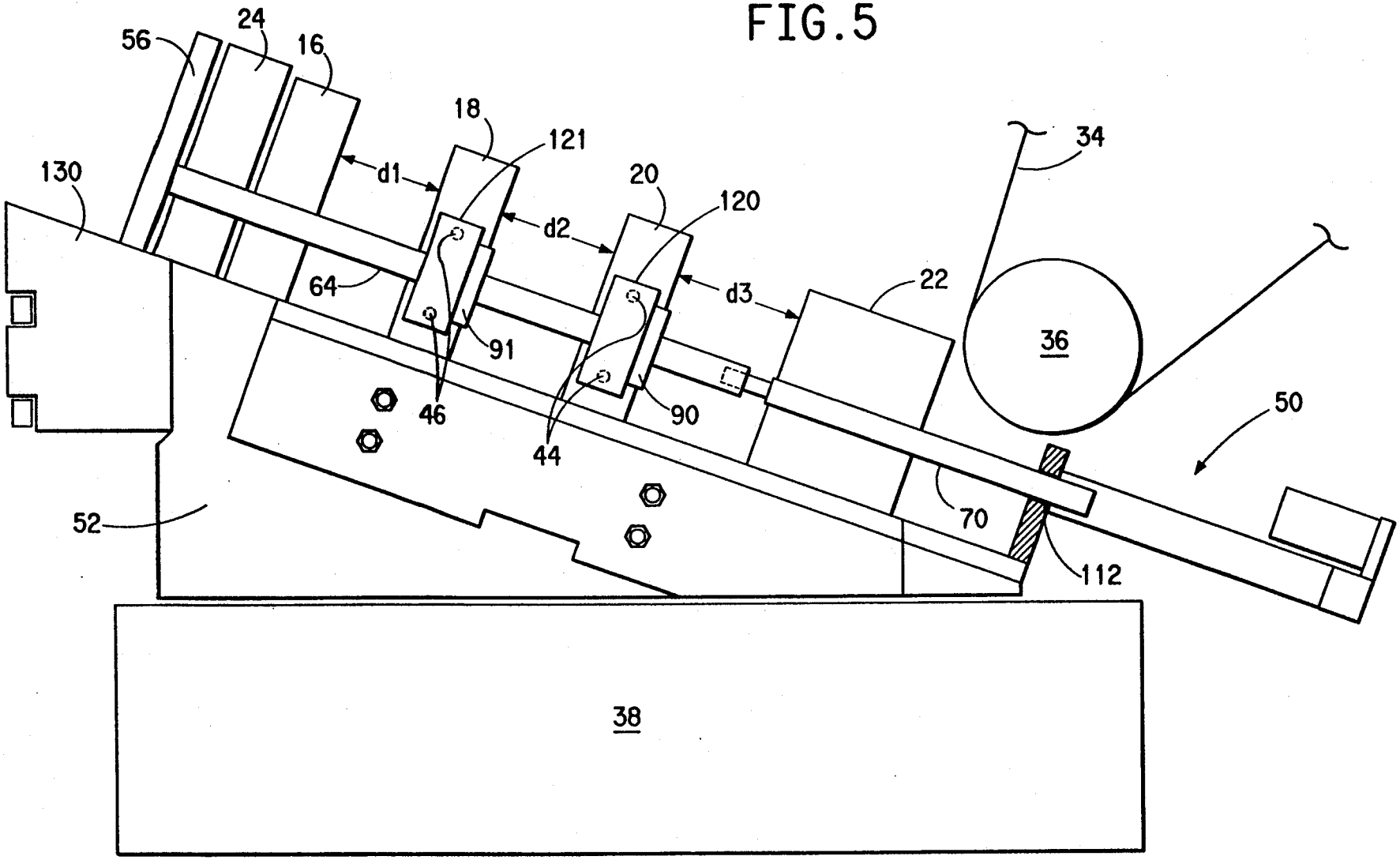
FIG. 5 is a schematic elevation view of the slide coating apparatus shown in FIG. 1 depicting the position of the plates during separation by the apparatus of this invention.

FIG. 5 shows the separation of the plates by the apparatus of this invention. In operation, the apparatus of the present invention so described is mounted on the coating apparatus and remains in place during the coating operation. The desired number of collars are mounted on the external shaft, and are positioned on the shaft such that the desired distance between the collars essentially corresponds to the desired opening distance between the plates. In FIG. 5, two collars 90 and 91 are spaced on the external shaft 64 so that between plates 16 and 18 there is a distance d1, between plates 18 and 20 there is a distance d2 and between plates 20 and 22 there is a distance d3, when the plates are fully separated. The separation distance d between adjacent plates can be different or the same. When power is applied to the motor assembly, rotational motion is translated through the drive assembly to linear motion which moves the internal shaft 70 of the actuator 62. As the actuator shaft 70 travels through the passage 112 in the third member 106 of the support assembly 52, the external shaft 64 moves in a path parallel to the inclined surface 32 of the coating head. The connector plate 56, the biasing plate 24 and the distribution plate 16 farthest from the backup roll move as one on the support rails, thereby separating the cavity between the farthest distribution plate 16 and its adjacent plate 18. An existing coating apparatus may need to be modified by the addition of an extension 130 to the support rails which generally extends at the same or substantially in the same direction as the existing support rail 40 so as to support one or more of the plates in a complete separation state. As the first collar 91 on the external shaft 64 comes into proximity of the openings 46 on the side of the adjacent plate 118, a first U-shaped block 121 is placed about the external shaft 64, with the extended legs of the block inserted into the openings 46 on the side of the plate 18. The collar 91 engages the U-shaped block 121, and linear motion is transferred to the plate 18, thereby separating plate 18 from plate 20. As the second collar 90 on the external shaft 64 comes into proximity of the openings 44 on the side of the plate 20, a second U-shaped block 120 is placed about the external shaft 64, with the extended legs of the second block 120 inserted into the openings 44 on the side of the plate 20. The collar 90 engages the U-shaped block 120, and linear motion is transferred to the plate 20, thereby separating plate 20 from plate 22. This process of placing a block, engaging the collar, and separating a plate can be repeated for as many plate separations as needed. The plates are most suitably separated starting with the plate farthest from the backup roll 36, and proceeding with each adjacent plate towards the backup roll. Generally, the plate closest the backup roll does not move.

The plates are returned or repositioned back in contiguous alignment by reversing polarity to the motor assembly. The linear motion on the actuator shaft 70, and thus the external shaft 64, is then reversed. Since the external shaft 64 is connected to the connector plate 56, the connector plate 56 pulls the plates 24, 16, 18, 20 and 22 along the support rails until the plates are in contiguous alignment against the plate closest to the backup roll 36. The U-shaped block 120 and 121 can be removed from their location on the external shaft as adjacent plates touch. If the U-shaped blocks 120 and 121 are retained on the shaft (which may be the case when only one or two plates are typically separated), the extended leg members 122 of the U-shaped blocks 120 and 121 or the blocks themselves can be modified to accommodate a pin or pins to prevent the blocks from dislodging from the external shaft 64. The U-shaped blocks 120 and 121 are not required to return the plates to coating alignment. The connector plate 56 and the actuator assembly 50 do not provide any additional biasing forces upon the coating head during the coating operation. A clutch mechanism in the actuator provides proper closure without damage to the plates.

What is claimed is:

1. In a slide coating apparatus comprising at least one slide surface disposed along a top portion of a front plate supported by a platform and a fluid supply cavity for supplying a coating fluid to the slide surface, the cavity formed at the juncture of a side surface of said front plate with a side surface of a back plate contiguous with the front plate and moveably supported by said platform, said side surface for each plate adjoining two opposite side ends thereof. and means for applying force to said back plate to maintain said back plate contiguous to said front plate, the improvement comprising:

means for moving said back plate away from said front plate to a first cleaning position along a direction substantially parallel to the slide surface, said moving means comprising at least a first actuator assembly connected between the back plate and the platform for effecting linear movement of a first shaft along said back plate direction.

2. The apparatus of claim 1 wherein said moving means comprises:

a connector plate adjacent the back plate opposite the front plate and coupled to said back plate, said connector plate having a first end portion which extends past one side end of the back and front plates;

said first shaft having a first end and a second end, wherein said first end is coupled to the extended first end portion of the connector plate and wherein the first shaft is oriented along a path parallel to the side ends of said plates;

said second end of the first shaft coupled to said first actuator assembly so that when said first actuator assembly imparts linear movement to the first shaft, the connector plate and the back plate move together and separate the back plate from the front plate.

3. The apparatus of claim 2 further comprising a first plate moveably supported by said platform intermediate and adjacent to the front and back plates, wherein the first plate has two side ends, each side end having two spaced openings.

4. The apparatus of claim 3 wherein the moving means further comprises:

the first shaft oriented along a direction substantially intermediate between the two spaced openings in one side end of the first plate;

a first means for engaging a collar, said collar fixedly mounted on the first shaft between said first and said second ends, said first engaging means having extended members which mate with said openings in the one side end of the first plate;

so that when said actuator assembly imparts linear movement to the first shaft, the engaging means after being placed about the first shaft by inserting the extended members into said openings in the one side end of the first plate, engages the collar and moves the first plate along the platform, thereby separating the first plate from the front plate.

5. The apparatus of claim 2 wherein the connector plate has a second end portion which extends past the other side end opposite the one side end of the front and back plates, the apparatus further comprising:

a second shaft having a first end and a second end, wherein said first end is coupled to the extended second end portion of the connector plate and wherein the second shaft is oriented along a path parallel to the side ends of said plates;

said second end of the second shaft coupled to a second actuator assembly so that when said first and said second actuator assembly impart linear movement to the first and second shafts, respectively, the connector plate and the back plate move together and separate the back plate from the front plate.

6. The apparatus of claim 5 further comprising a first plate moveably supported by said platform intermediate and adjacent to the front and back plates, wherein the first plate has two side ends, each side end having two spaced openings.

7. The apparatus of claim 6 wherein the moving means further comprises:

the first shaft oriented along a direction substantially intermediate between the two spaced openings in one side end of the first plate;

the second shaft oriented along a direction substantially intermediate between the two spaced openings in the side end opposite the one side end of the first plate;

a first means for engaging a collar, said collar fixedly mounted on the first shaft between said first and said second ends, said first engaging means having extended members which mate with said openings in the one side end of the first plate;

a second means for engaging a collar, said collar fixedly mounted on the second shaft between said first and second ends, said second engaging means having extended members which mate with said openings in the opposite side end of the first plate;

so that when said first and said second actuator assembly impart linear movement to the first and second shafts, respectively, the first and second engaging means after being placed about the first and second shafts, respectively, by inserting the extended members into said openings in the side ends of the first plate, engage the collars and move the first plate along the platform, thereby separating the first plate from the front plate.

8. The apparatus of claim 2 wherein the connector plate is coupled to the back plate by a tie bar.

9. The apparatus of claim 1 wherein the actuator assembly is electromechanically driven.

* * * * *